US008281921B2

(12) United States Patent
Cohen

(10) Patent No.: US 8,281,921 B2
(45) Date of Patent: Oct. 9, 2012

(54) CONTAINER ENABLING MIXING AT LEAST TWO SUBSTANCES THEREIN

(76) Inventor: Ofer Moshe Cohen, Ma'ale-Adummim (IL)

( * ) Notice: Subject to any disclaimer, the term of this patent is extended or adjusted under 35 U.S.C. 154(b) by 0 days.

(21) Appl. No.: 12/523,735

(22) PCT Filed: Oct. 7, 2007

(86) PCT No.: PCT/IL2007/001200

§ 371 (c)(1),
(2), (4) Date: Jul. 20, 2009

(87) PCT Pub. No.: WO2008/093317

PCT Pub. Date: Aug. 7, 2008

(65) Prior Publication Data

US 2011/0011755 A1 Jan. 20, 2011

Related U.S. Application Data

(60) Provisional application No. 60/898,124, filed on Jan. 30, 2007, provisional application No. 60/907,294, filed on Mar. 28, 2007, provisional application No. 60/924,892, filed on Jun. 4, 2007.

(51) Int. Cl.
*B65D 25/08* (2006.01)

(52) U.S. Cl. ..... 206/222; 206/219; 426/131; 426/397

(58) Field of Classification Search ..... 206/219, 206/221, 222; 426/112, 115, 131, 132, 397, 426/401; 222/81, 82; 215/DIG. 8
See application file for complete search history.

(56) References Cited

U.S. PATENT DOCUMENTS

| | | | | | |
|---|---|---|---|---|---|
| 611,520 | A | | 9/1898 | Smith | |
| 3,696,919 | A | | 10/1972 | Miles | |
| 3,995,778 | A | * | 12/1976 | Gamadia | 222/399 |
| 4,627,986 | A | * | 12/1986 | Bardsley et al. | 426/112 |
| 4,784,678 | A | * | 11/1988 | Rudick et al. | 62/4 |
| 4,836,370 | A | | 6/1989 | Bosshard | |
| 5,340,595 | A | * | 8/1994 | Cameron-Price | 426/112 |
| 5,517,804 | A | | 5/1996 | Lynch | |
| 5,552,168 | A | * | 9/1996 | Cameron-Price | 426/106 |
| 5,683,732 | A | * | 11/1997 | Baxter et al. | 426/115 |
| 6,250,346 | B1 | * | 6/2001 | Castillo | 141/100 |
| 7,832,184 | B2 | * | 11/2010 | Sillince | 53/420 |
| 2002/0088724 | A1 | * | 7/2002 | Morck | 206/219 |

* cited by examiner

*Primary Examiner* — David Fidei

(57) ABSTRACT

A plural chambered container for storing separately a plurality of substances for mixing prior to opening the container. The container comprises a closed outer container having a side wall, bottom and top. It further comprises an inner chamber with a designated opening area, wherein the inner chamber is operatively attached to the bottom of the outer container. In addition the outer container is filled with a first substance and the inner chamber is filled with a second substance. The outer container is filled with a one substance and the inner chamber is filled with another substance. Upon pressing the side walls of said outer container, the designated opening area is opened thereby causing the substance in the inner chamber to mix with the substance in the outer container.

15 Claims, 3 Drawing Sheets

CONTAINER ENABLING MIXING AT LEAST TWO SUBSTANCES THEREIN

CROSS REFERENCE TO RELATED APPLICATIONS

This application is a U.S. National Phase Application under 35 U.S.C. 371 of PCT International Application No. PCT/IL2007/001200, which has an international filing date of Oct. 7, 2007, and which claims priority from U.S. provisional patent application No. 60/898,124, filed on Jan. 30, 2007, U.S. provisional patent application No. 60/907,294, filed Mar. 28, 2007, and U.S. provisional patent application No. 60/924,892, filed Jun. 4, 2007, all of which are incorporated herein by reference in their entirety.

FIELD OF THE INVENTION

The present invention relates to storage containers, and more particularly to a substance storage container having multiple compartments for storing a plurality of different substances intended for mixing or separately dispensing upon pouring.

BACKGROUND OF THE INVENTION

Mixing drinks is a very popular way of enhancing the drinking experience of both alcoholic and non-alcoholic beverages. The preparation of cocktails involves mixing a plurality of drinks immediately prior to consumption. Apart from beverages, some medications also require mixing of at least two substances, prior to consumption. A variety of drinks are known to be prepared by mixing well defined quantities of two substances of the drink which may be composed either of liquids or of a liquid and a powdered product.

It has been observed that, for reasons of preservation or freshness of taste, it is necessary or merely advantageous if the mixing of the ingredients is effected immediately before consumption. Presently available beverage containers such as aluminum cans, glass and plastic bottles are limited in respect to accommodating more than one type of drink.

In addition, there is a variety of liquid and non-liquid substances that require separate storage and mixing prior to use in beverage or other applications. It would be therefore advantageous to have a container that combines separate storage of substances together with enabling an easy mixing of said substances.

SUMMARY OF THE INVENTION

The present invention relates to a container enabling at least two substances to be mixed immediately prior to consumption. There is provided a plural chambered container for storing separately a plurality of substances for mixing prior to opening the container. The container comprises a closed outer container having a side wall, bottom and top. It further comprises an inner chamber with a designated opening area, wherein the inner chamber is operatively attached to the bottom of the outer container. In addition the outer container is filled with a first substance and the inner chamber is filled with a second substance. Upon pressing the side walls of said outer container, the designated opening area is opened thereby causing the substance in the inner chamber to mix with the substance in the outer container.

BRIEF DESCRIPTION OF DRAWINGS

The subject matter regarded as the invention will become more clearly understood in light of the ensuing description of embodiments herein, given by way of example and for purposes of illustrative discussion of the present invention only, with reference to the accompanying drawings (Figures, or simply "FIGS."), wherein.

Figure 1:
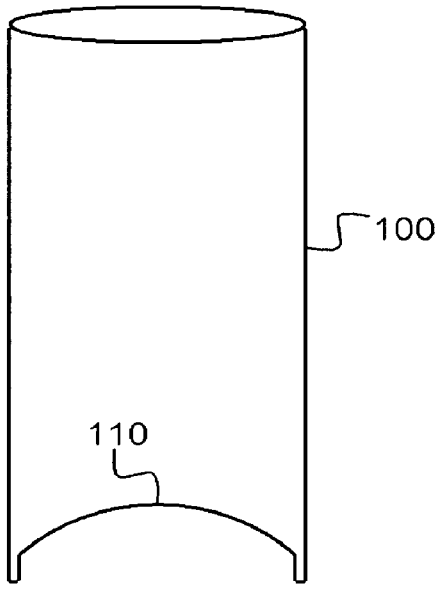
FIG. 1 is a schematic view of the outer container according to some embodiments of the present invention.

The drawings together with the description make apparent to those skilled in the art how the invention may be embodied in practice. The invention is by no means limited to the size, shape, or proportion as described in the drawings.

Further, where considered appropriate, reference numerals may be repeated among the figures to indicate corresponding or analogous elements.

DETAILED DESCRIPTION OF THE INVENTION

The present invention discloses a plural chambered container for separately storing a plurality of substances for mixing prior to opening the container. The container comprises a closed outer container having a side wall, bottom and top. In addition, the outer container has an elevated surface extending inwards from its inner side. The container further comprises an inner chamber with a designated opening area and attaching means configured to cling on the elevated surface. The outer container may be filled with a first substance and the inner chamber is filled with a second substance. Pressing the side walls of the outer container in a predetermined location causes the designated opening area on the inner chamber to open thereby enabling the mixing of the substance within the inner chamber and the substance within the outer container.

Figure 2:
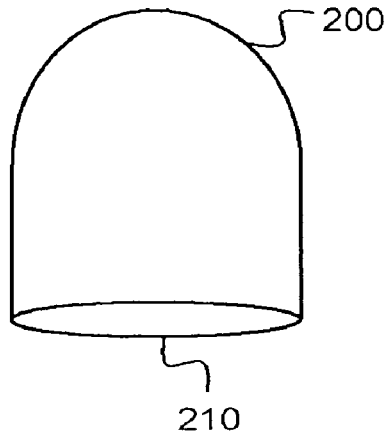
FIG. 2 is a schematic view of the inner chamber according to some embodiments of the present invention.
Figure 3:
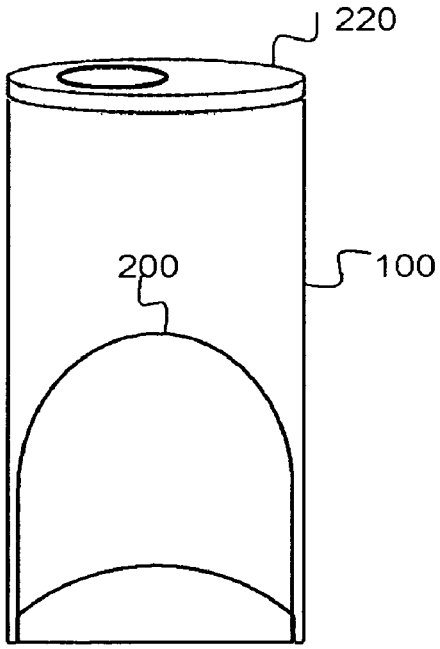
FIG. 3 is a schematic view of the inner chamber firmly attached to the bottom of the outer container according to some embodiments of the present invention.

FIG. 1 shows the outer container 100 in the form of a beverage can and the elevated surface as a dome-like bottom 110. FIG. 2 shows the inner chamber 200 with an opening 210. FIG. 3 shows the inner chamber firmly attached to the bottom of the outer container 110. The inner chamber 200 is sealed by pressing it towards the dome-like bottom 110 and the outer container is sealed by a lid 220 optionally with an open-able hatch within the lid. It should be noted that dome-like bottom 110 is common in standard aluminum beverage can. However, any elevated surface, in any shape or size that serves as the bottom of any container may be regarded as a suitable anchoring means for the inner chamber to be pressed upon. When pressing the inner chamber 200 towards the dome-like bottom in such way that the inner chamber's opening 210 is against the bottom, the inner chamber's opening (which has slightly smaller diameter than the outer container's bottom's diameter) is strongly attached to the bottom by the pressure created due to the difference between the above mentioned diameters.

Then, when pressing the side walls of the outer container, the inner chamber is tilted thereby disengaged from the bottom of the outer container. This causes the mixing of the substances.

The present invention is not limited to a dome-like bottom. Alternatively, an elevated surface may serve as an anchor for the inner chamber. The elevated surface does not necessarily need to be positioned on the bottom of the outer container. Rather it may be anywhere on the inner side of the outer container.

According to some embodiments of the invention, the opening area of the inner container comprises a rim configured to cling upon the elevated surface of the outer container such that the opening area is sealed. Upon pressing the side walls of the outer container, the chamber is tilted such that the rim of the opening area disengages from the elevated surface of the outer container causing the substance in the chamber to mix with the substance in the outer container.

According to some embodiments of the invention, the inner chamber is made from a material having a specific gravity lower than the specific gravity of the substance within the outer container, thus the disengagement leads to floating of the inner chamber and to a quicker mixing between the substances.

Figure 4:
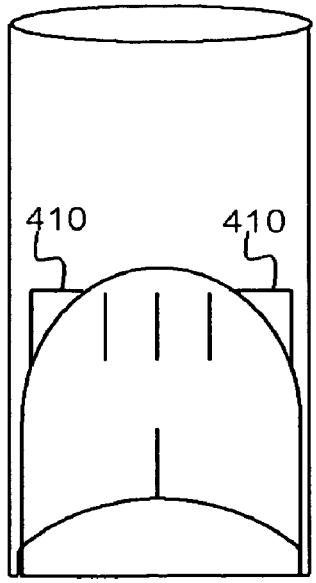
FIG. 4 is a schematic view of the outer container and the inner chamber wherein the inner chamber further comprises fins, according to some embodiments of the present invention.

FIG. 4 shows the inner chamber with fins 410 on its external circumferential area. These fins may be set at various ways and for various purposes while enabling the expansion of the total inner chamber's diameter while maintaining the free movement of fluids around the inner chamber: A line of radial fins 410 on the upper circumferential area of the inner chamber 200 may be used as a mean to create higher proximity of the inner chamber to the outer container's side walls. A set of fins 410 at any point of the inner chamber's 200 circumferential area may assist in maintaining a marginal space from the inner chamber's body and the external container's walls, to enable freedom of movement of the fluids in the outer container 100 and around the inner chamber 200. The fins 410 may be at any shape and size.

According to some embodiments, the inner chamber 200 is filled with certain substance like liquid or powder. The inner chamber 200 and the can's dome are then pressed one towards each other until the dome is pressed into the inner chamber's opening and seals it to prevent any leakage or release of the substance stored in the inner chamber. The attachment is performed when the inner chamber's opening turns upward and the aluminum can is turned upside down. In such way the aluminum can is pressed down until the dome reaches the inner chamber's opening and seals it.

The aluminum can, now containing the inner chamber 200 which is attached to its bottom, may be filled with certain substance. After filling the can, it may be further processed like any other normal can (seaming, packaging etc.). At this stage, the two separately stored substances (one in the inner chamber and the other in the can around the inner chamber) can be mixed by pressing on the external circumferential area of the can from outside in such way that weakens the grip of the inner chamber's opening on the can's dome. The inner chamber is then pops up and the substance which was stored in it is being released and mixed with the substance which is stored in the can.

By means of example only, the inner chamber 200 which contains alcoholic drink such as Vodka and attached to the dome-like bottom of a can which contains a mixer (e.g. an energy drink or any juice). When the user wishes to drink, he or she presses on the can from outside to force the inner chamber to detach from the dome-like bottom. The alcohol is then releases into the mixer and the user may drink a fresh mixed drink.

The outer container is by no means limited to a can. It may mean any container with similar characteristics, whether it's a bottle, a can, a box or any other container. The inner chamber and/or the can and/or its dome-like bottom may be made of aluminum, plastic or any other substance as long as the above functionality is maintained. The stored substances may be any substances which the manufacturer chooses. The above technology may be used for any application which requires to separately storing more than one ingredient until just before usage when the ingredients should be mixed. Examples may be: Alcoholic drink and a mixer, different ingredients of any mixed drink, Hair color and hydrogen, paint and thinner, powder and a fluid and so on. The pressing on the can may be before or after its opening. The inner chamber and/or the can and/or its dome may be of any shape and size as long as the above functionality is maintained.

Figure 5:
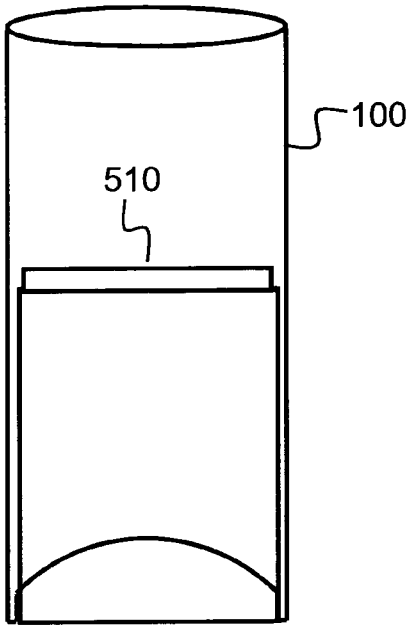
FIG. 5 is a schematic view of the inner chamber with a lid smaller in diameter than the inner chamber according to some embodiments of the present invention.
Figure 6:
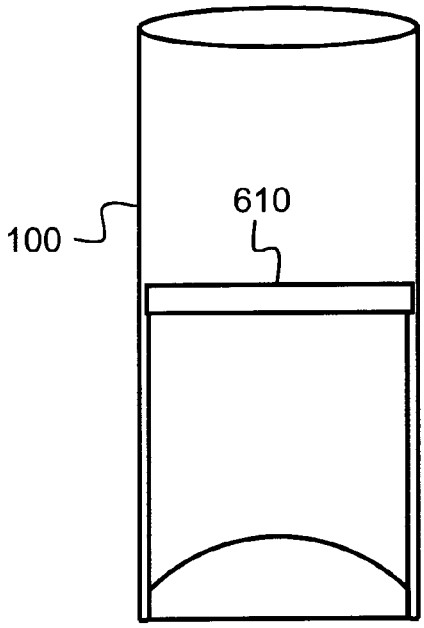
FIG. 6 is a schematic view of the inner chamber with a lid larger in diameter than the inner chamber according to some embodiments of the present invention

FIG. 5 and FIG. 6 show how a lid 510 or 610 may serve as a cover for a designated opening area. According to some embodiments of the invention, the inner chamber 200 may be a hollow cylinder (simple cylinder or other shape) wherein its bottom is attached to the dome-like bottom by the above mentioned technology, and its top is covered with a lid. The lid may be aluminum or other foil attached with heat seal technology, or it may be a rigid/flexible lid which seals the top side of the inner chamber by pressure (the same concept of the above mentioned technology). In such case the lid may be either a little smaller than the inner chamber's top diameter, or a little larger than the inner chamber's top diameter. In both cases the lid is pushed on the top side to create pressure on the overlapping circumferential areas of the inner chamber and the lid.

According to some embodiments of the invention the lid may be located anywhere on the outer surface of the inner chamber. The lid may be made of a robust or flexible material, so that it may be disengaged or removed from the opening area. Alternatively the lid may comprise a thin film, either metallic or non metallic whereby opening the lid is performed by tearing or breaking it.

In the case that the lid covers the designated opening area located on the top of the inner chamber, opening of the lid is performed by pressing the outer walls of the outer in two opposite directions. This causes a deformation of the rim of the opening area that leads to the disengagement, removal, breaking or tearing of the lid, thus allowing the mixing of the substance within the inner chamber with the substance within the outer container. Alternatively, in the case where the lid is in the form of a film covering the opening area and located on the walls of the inner chamber, the opening of the lid is performed by pressing the side walls of the outer contained in a position adjacent to the lid. By this the force applied upon the lid causes the tearing or breaking thereof.

Alternatively, the lid is a film and covers the opening area located on the top of the inner chamber. By squeezing two opposite sides of the outer container and therefore two opposite sides of the inner chamber one toward the other, a force is created causing the other two opposite sides of the inner chamber to be pushed one way from the other. The motion of the two opposite pressed sides one towards each other and/or the motion of the other two sides one away from the other, are used to either tear up, detach, move, remove, cut etc According to some embodiments of the invention, the lid further comprises lead lines configured to focus the force applied upon the inner chamber. These lines may be tearing or breaking lines or scored line characterized by a weakened area and it may be used such that lids of any sized and shape are formed. The lid may be attached to the inner chamber by heat sealing or any other attachment technology.

The lid may be made of a substance which is designed to reduce its self face area upon its detachment, cutting, tearing up, removal, moving etc' from the inner chamber's body, By curling around itself, shrinking, folding or any other actions of area face reduction.

Figure 7:
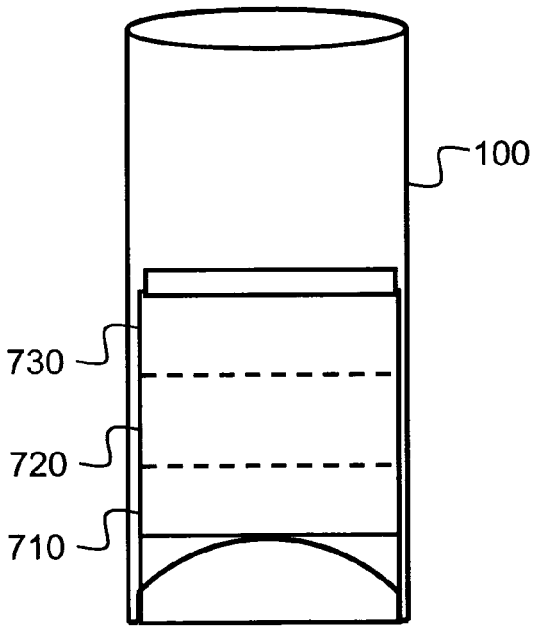
FIG. 7 is a schematic view of multiple inner chambers with breaking lines and a lid according to some embodiments of the present invention.

FIG. 7 shows the inner chamber divided into three chambers in such way that the lower chamber 710 contains certain substance and is sealed by the dome-like bottom of the outer container 100, while the middle chamber 720 is filled with another substance and while the top chamber 730 is filled with another substance sealed with a lid. Releasing the lid will release the substance from the top chamber, and releasing the inner chamber from its grip on the dome will release the substance from the lower chamber. Breaking the seal between the middle and the top chamber will release the middle chamber and any additional chamber which is not the lower or top chamber.

Figure 8:
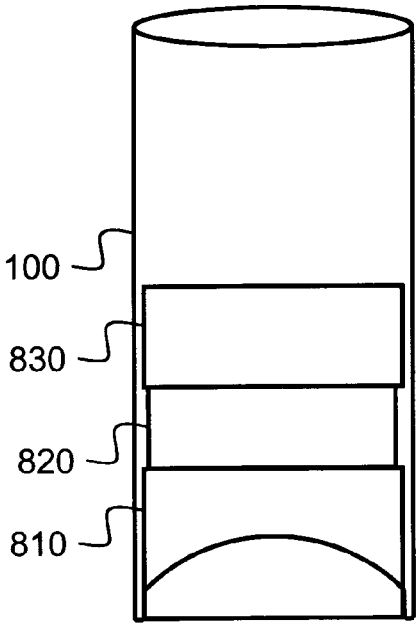
FIG. 8 is a schematic view of multiple inner chambers concatenated, according to some embodiments of the present invention; the according to some embodiments of the present invention.
Figure 9:
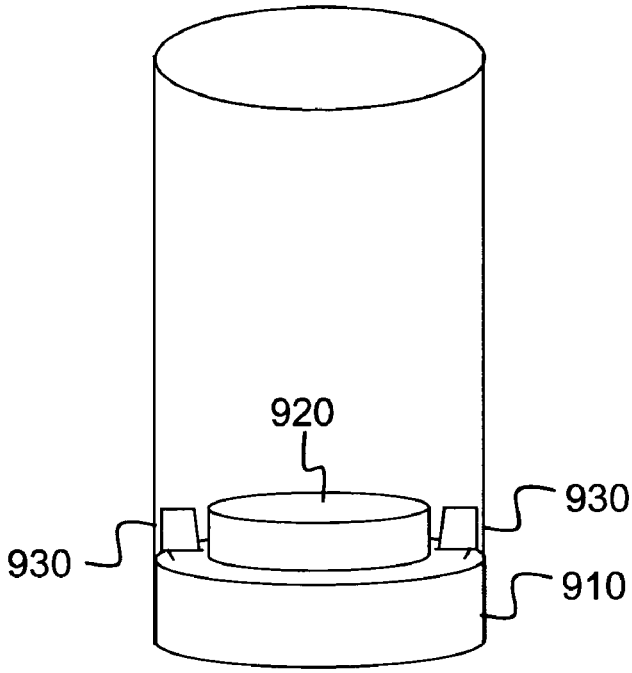
FIG. 9 is a schematic view of inner chamber with a hatch on top of it, according to some embodiments of the present invention.

FIG. 8 shows a set of inner chambers (three by means of example) that may be attached one on the top of the other in such way that the lowest inner chamber is attached to the dome-like bottom at the bottom of the outer container, and the inner chamber above it is attached to its top and seals it as well. Each inner chamber may contain different substance. By pressing the external container in different heights, different inner chamber is detached and its content is poured out to the outer container's space.

Figure 10:
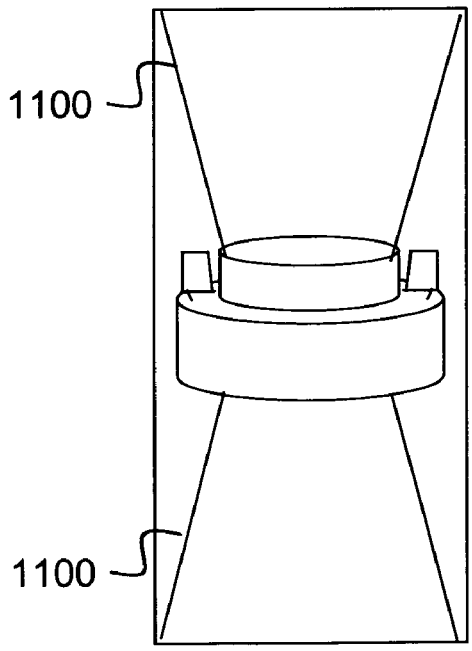
FIG. 10 is a schematic view of the inner chamber with a hatch and legs according to some embodiments of the present invention.

FIG. 10 shows the inner chamber with one or more legs 1100 on it, in such way that these legs prevent the inner chamber from rising towards the top side of the outer container. This configuration prevents the possibility that the inner chamber's body will block the opening of the outer container when pouring its content out. The legs may be designed to direct the top cover of the external container or any other point in the external container's circumferential area.

According to some embodiment of the invention the inner chamber comprise an opening on its top, wherein the opening is sealed with a cover in the form of a hatch. The cover is applied and permanently attached to the inner chamber 200 in order to seal any opening which is used for filling up the inner chamber, after the substance or substances were poured into the relevant compartments. The attachment of the hatch may be performed by bending an excessive surface of the inner chamber which was intentionally left around the opening for this purpose around the cover's edges (in a similar manner to the process of aluminum can seaming) or by pressure or welding or gluing or screwing methods or by any other known technological methods. In the case of a hatch, the opening mechanism of the cover-hatch may be attached to the opening mechanism at the top of the outer container 100 to enable opening both the outer container 100 and the inner chamber 200 at the same time.

According to some embodiments of the invention, the cover may have a perforated extension around it in such way that the cover and the extended area or diameter is equal to the outer container's area or diameter in order to provide additional safety. This perforated area will block any loose parts if such parts will be resulted in any stage of the product life cycle. This perforated area may also be a surface that is attached to the cover in any way. The cover may be in any shape and any size as long as it provides the required sealing of the inner chamber 200 on its top side, and as long as it does not interrupt its functionality.

The opening hatch (or simply, hatch) may be an integral area of the inner chamber 200 surface, or it may be an add-on which is attached to the inner chamber 200, which when opened, enables the release of the stored substance or substances from the inner chamber 200 or from certain compartment or compartments. The hatch may be located anywhere on the external surface of the inner chamber 200 as long as each compartment in the inner chamber 200 which contains a substance or substances that are to be released, has at least one hatch.

According to some embodiments of the invention, the hatch is defined by breaking lines along the top of the inner chamber 200. The breaking lines may be in the form of weakened lines along the desired boarder of the hatch either by slotting or thinning the external surface of the inner chamber 200 in a way that creates a half closed shape, meaning one side of the shape is not being weakened and is designed to function as the opening axle. Once an external force is being applied on the hatch from the outside, the hatch is being cut off from the main body's surface along the breaking lines, and stays attached to the main body's surface by the axle, while being folded into the internal space of the inner chamber 200. The hatch and the axle may be created in any shape and any size, and it may be designed to be opened inwardly, outwardly, vertically up or down, or horizontally sideways, or in any other direction It is also possible to create a hatch by slotting a full closed shape, meaning there is no axle. In such case, when the opening mechanism is activated, the hatch can be fully cut off from the main body's surface. Therefore, the hatch should be attached to any other part of the inner chamber. This attachment is aimed to ensure that the hatch will not be free to travel within the inner chamber and the outer container.

According to other embodiments, weakening the whole area of the inner chamber surface is also possible. This is aimed to function as the hatch by thinning the area or systematically cover it with slotted lines. In such case, the opening mechanism will punch or tear up or cut off the hatch's surface to enable the release of the stored substance or substances. The hatch should be designed in such way that no breaks, fractions or torn pieces will be detached from the inner chamber to freely travel in the outer container's space.

According to yet another embodiment, the inner chamber should have an opened area for each hatch. This hole is covered and sealed by a weak substance such as nylon, plastic sheet, aluminum sheet or similar substances. This substance should be attached to the inner chamber's surface by gluing, welding or any other known technology. This piece of substance may be designed to cover one or more holes with the same piece and may be attached to the inner chamber in any point or points as long as it provides the required sealing for the holes. If the hatch's edges are also the inner chamber's edges, it may be necessary to create a rim which will be used as the area to which the add-on cover is attached. For example, a piece of aluminum sheet may be attached to the inner chamber's surface around the hole, or it may wrap larger area of the inner chamber in order to cover more than one hole with the same piece. The hatch should be designed in such way that no breaks, fractions or torn pieces will be detached from the inner container to freely travel in the outer container's space.

According to some embodiments of the invention, the hatch is further characterized in being attached to the inner chamber via a springy portion. Specifically, the springy portion may be part of the substance the inner chamber is comprised of. The springy portion may be pre-curved chamber wall configured to create torsion. Once the conditions for releasing the hatch are met, the springy portion enables a faster opening of the inner chamber, hence a faster mixing of substances.

According to some embodiments of the invention, an opening mechanism is aimed to enable the opening of the hatches from outside of the outer container. Each hatch may have a dedicated opening mechanism which is located against it, although it is possible to use the same opening mechanism to open more than one hatch. The opening mechanism has an external side which is located against the internal surface of the external container, and an internal side which is attached or located against the hatch. As the user presses on the pressing area from outside the outer container, he or she pushes the outer container's side walls towards the external side of the opening mechanism which in turn transfers this force to the hatch, which is then opened.

The opening mechanism may be directly attached to the hatch or to the spring-like surface or it may be attached to the main body or to the cover whether directly or through a dedicated attached part or arm, or to any other part of the inner chamber 200, or it may also be attached to the internal surface of the outer container 100.

The opening mechanism is designed to either push the hatch or to punch or tear it up, depending on the method used to create the hatch. The opening mechanism may be in any shape and any size as long as it functions as described above and as long as it does not interrupt the inner chamber functionality. The opening mechanism may be designed to open the hatch in any direction, whether the hatch is designed to be opened vertically, horizontally, diagonally or in any other direction.

According to some embodiments of the invention, no opening mechanism is required to open the hatch. In such embodiments, the force which is generated by the user's pressing is directed and applied directly to the hatch in order to start the opening process which will be then complemented by the force of the spring-like surface.

The opening mechanism should be designed to either apply a force on the hatch in order to cut it off from the inner chamber's surface. If used to punch or tear up, the internal side of the opening mechanism should be designed to create a sufficient opening for the free releasing of the stored substance or substances. This may be gained by designing the internal side of the opening mechanism which is aimed to directly touch the hatch as a rigid part that will tear the hatch's area, or by sharp edges which will punch or tear the hatch's area in as large area as possible.

According to some embodiments, the opening mechanism may be a button wherein its external side may be shaped to fit the outer container's shape. For example: an arc, to fit the external container's round shape. Nonetheless, it is possible to use any other shape. The height of this button is optional. A surface can be attached to the external side of the button which provides additional height and larger pressing surface for the user. The internal side of the button may have thin and rigid end along its end's line which is located against the hatch and which is designed to fit the shape of the hatch's slotted line. As the user presses the pressing area from outside the external container, the button is being pushed to hit the slotted line of the hatch and cut the hatch off from the main body's surface and trigger the opening process of the inner chamber. In order to gain efficient opening the button's internal side's end is designed to hit the hatch's slotted line in a gradual manner, point after point.

Alternatively, the internal side of the button may be designed to just push the area within the hatch's slotted line. The internal side of the button may be any rigid part in any shape and any size as long as the contact point of the rigid part with the hatch is smaller than the area of the hatch itself. This rigid part may be attached directly to the hatch or the attached spring-like surface, or it maybe attached to the button's external side which in turn is attached to any other part of the inner chamber.

According to some embodiments of the invention, the designated opening area, when covered by a hatch or a lid is opened using a lever that physically connects the hatch or the lid and the walls of the outer container. The lever delivers any pushing motion of the walls of the outer container into the hatch or the lid thus facilitating opening thereof.

According to some embodiments a horizontal-to-vertical opening mechanism is provided. This mechanism is aimed to open the hatch in case when the hatch is located on the inner chamber bottom or top. In such case, a round or diagonal arm is used, which one of its ends is located near the external surface and the other end is located near the hatch. The arm is attached to the inner chamber. When the user presses the pressing area from outside the external container, the horizontal force of the pressing is translated to vertical force by both the diagonal or rounded shape of the arm and by its attachment to the inner chamber which does not enable it to move horizontally and therefore translate the force to vertical position.

According to some embodiments of the invention, the user can control the mixture (dosage—when more than one compartment contain the same substance, versus compound—when each compartment contains different substance, versus the combination of dosage and compound when more than one compartment contain the same substance while at least one other compartment contain different substance) by deciding which of the inner chamber stored substances are to be mixed with and into the substance in the external container. This can be controlled by pressing only in the location of the relevant opening mechanism that controls the relevant substance's compartment.

In case that the inner chamber include only one compartment to contain one substance to be mixed with the external container's substance, the pressing mechanism might include two opposite buttons that both open two opening-hatches of the same compartment in order to enable easy opening and easy release of the stored substance. Nonetheless, if needed, in such case the system can function also with one or more opening mechanisms to open one or more opening-hatches.

The inner chamber 200 is designed to be made of aluminum, steel or plastic, and may combine other weak substances for the hatches like thin nylon, thin plastic sheet, thin aluminum sheet etc., but can be made of any other substance as long as the inner chamber fulfill its functionality. For example, it is possible that the inner chamber 200 will be made of a very flexible substance like silicon or nylon or any other similar substance. In such case, it is important that the inner chamber 200 is strong enough in order to keep its stored substance or substances in separation from the external container's substance. In such case no hatches are necessary (although may be used) and the opening mechanism may be aimed at punching or tearing the flexible inner chamber in order to release its stored substance or substances. In such case it is possible to control the inner chamber 200 location within the outer container 100 by attaching it to the outer container by suitable attaching substance.

According to some embodiment, multiple use outer containers may be used. The outer container's top may have a screwing mechanism which certain screwing covers may be fitted to. Thus, the user may use such disposable or multiple-usage external container, while sealing the external container with other existing dedicated cover (e.g. a baby bottle cover).

The inner chamber cover is attached to the inner chamber after filling it up with the required substance/s. All of the inner chamber's parts are attached as one single unit which stays unite all along its life stages, also after applying the opening mechanisms. No fragments or free pieces are produced in any stage of the product life-cycle.

In order to prevent false activation of the opening mechanism (designated opening areas) by external forces such as an unintentional blow to the external container around the inner chamber opening area, a small gap between the outer container's surface and the inner chamber's opening mechanism may be maintained. Another optional mechanism may be a ring which is located on the external surface of the outer container around the pressing area/s. This ring may be moved, turned or removed to enable the pressing when required. This ring maybe of any size, shape, substance and thickness, or in any combination of these. This ring may have holes or thin areas which can be directed to the pressing area/s by moving the ring, to enable the pressing through these holes or thin areas.

In the above description, an embodiment is an example or implementation of the inventions. The various appearances of "one embodiment," "an embodiment" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "some embodiments", "an embodiment", "one embodiment" or "other embodiments" means that a particular feature, structure, or characteristic described in connection with the embodiments is included in at least some embodiments, but not necessarily all embodiments, of the inventions.

It is understood that the phraseology and terminology employed herein is not to be construed as limiting and are for descriptive purpose only.

The principles and uses of the teachings of the present invention may be better understood with reference to the accompanying description, figures and examples.

It is to be understood that the details set forth herein do not construe a limitation to an application of the invention.

Furthermore, it is to be understood that the invention can be carried out or practiced in various ways and that the invention can be implemented in embodiments other than the ones outlined in the description above.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The descriptions, examples, methods and substances presented in the claims and the specification are not to be construed as limiting but rather as illustrative only.

Meanings of technical and scientific terms used herein are to be commonly understood as by one of ordinary skill in the art to which the invention belongs, unless otherwise defined.

The present invention can be implemented in the testing or practice with methods and substances equivalent or similar to those described herein.

Any publications, including patents, patent applications and articles, referenced or mentioned in this specification are herein incorporated in their entirety into the specification, to the same extent as if each individual publication was specifically and individually indicated to be incorporated herein. In addition, citation or identification of any reference in the description of some embodiments of the invention shall not be construed as an admission that such reference is available as prior art to the present invention While the invention has been described with respect to a limited number of embodiments, these should not be construed as limitations on the scope of the invention, but rather as exemplifications of some of the embodiments. Those skilled in the art will envision other possible variations, modifications, and applications that are also within the scope of the invention. Accordingly, the scope of the invention should not be limited by what has thus far been described, but by the appended claims and their legal equivalents. Therefore, it is to be understood that alternatives, modifications, and variations of the present invention are to be construed as being within the scope and spirit of the appended claims.

What is claimed is:

1. A container comprising:

a) an outer container adapted to contain outer contents, said outer contents comprising at least one substance, wherein said outer container comprises:
   i. a body comprising a bottom and at least one side wall,
   ii. an elevated area extending inwards from an inner side of the outer container, said elevated area comprising at least one elevated surface, and
   iii. an outer opening adapted to be closed by a lid;

b) an inner chamber adapted to contain inner contents, said inner contents comprising at least one substance, wherein said inner chamber comprises:

a. a gripping area adapted such that when said gripping area is coupled to said elevated area a press fit is induced between the gripping area and the elevated area, b. at least one compartment, and c. an opening area adapted to form a passageway through which at least a portion of said inner contents can exit at least one compartment of said inner chamber when said opening area is opened, wherein said opening area is adapted to be closed by closing means comprising one of said elevated area and a lid, said closing means adapted to seal said inner chamber and hold said inner contents separated from said outer contents to prevent any passage of substance between said inner chamber and said outer container, wherein upon the opening of said outer opening, said opening area remains closed to maintain separation between said outer contents and said inner contents, and wherein the opening area is adapted to be opened up against the outer contents by a force exerted on said inner chamber from outside the outer container, in such way that causes at least partial disengagement of said inner chamber from said closing means, thereby enabling a release of at least a portion of the inner contents from the inner chamber.

2. A container according to claim 1, wherein said outer container is adapted to be opened from outside said outer container, and wherein said opening area is operatively separated from said outer opening such that an opening up of said opening area against said outer contents is adapted to be performed separately from opening up said outer container, thereby enabling said opening area to remain close when said outer opening is opened.

3. A container according to claim 1, wherein said force is adapted to be applied regardless of the ability to stretch said outer container.

4. A container according to claim 1, wherein said outer container is pressurized by gas.

5. A container according to claim 1, wherein said elevated area is located at the bottom of said outer container.

6. A container according to claim 1, wherein said outer container further comprises a top adapted to be operatively attached to said body in order to form a closed outer container.

7. A container according to claim 1, wherein said opening area is said gripping area and said closing means is said elevated area, such that said opening area is closed by said elevated area and said inner chamber is attached to said elevated area, and wherein said opening area is adapted to be opened up upon applying a pressure on at least one area on an outer surface of said outer container, such that at least a part of said pressure is transferred to said inner chamber, thereby causing at least partial disengagement of said opening area from said elevated area by at least one of (a) tilting said inner chamber, (b) pushing aside said inner chamber, (c) bouncing said inner chamber away from the elevated area and (d) deforming said opening area, thereby enabling a release of at least a portion of said inner contents from within said inner chamber.

8. A container according to claim 1, wherein said gripping area is gripping said elevated area and said closing means is a lid, such that said opening area is closed by said lid and said inner chamber is attached to said elevated area, wherein said opening area of said inner chamber is adapted to be opened upon applying a pressure on at least one area on said outer surface of said outer container, such that at least a part of said pressure is transferred to said inner chamber, thereby causing said opening area to be opened up by at least one of (a) deforming at least one of said opening area and said lid, thereby inducing at least partial disengagement of said lid from said opening area, and (b) exerting a tension on a surface of said lid, thereby damaging the entirety of said surface of said lid, thereby enabling a release of at least a portion of said inner contents from within said inner chamber.

9. A container according to claim 1, wherein an average density of said inner chamber is lower than a density of said outer contents, such that said inner chamber is adapted to rise following a disengagement of said inner chamber from said elevated area.

10. A container according to claim 1, wherein said elevated area comprises an undercut, and wherein a rim adjacent to said gripping area comprises a protruded area configured to fit within said undercut.

11. A container according to claim 1, wherein said inner chamber comprises a plurality of openable compartments, each having an opening area that is closed by one of (a) said elevated area and (b) a lid, and wherein each of said opening area of said plurality of openable compartments can be opened in at least one of a selective and simultaneous manner.

12. A container according to claim 1, wherein said elevated area is said inner chamber, such that said outer container and said inner chamber are formed as a single part.

13. A container according to claim 1, wherein said inner chamber comprises at least one protrusion extending outwards from an outer surface of said inner chamber, and wherein said at least one protrusion is adapted in at least one of the following ways:

a) to enable a free flow of substance through a gap created by said at least one protrusion between the outer surface of said inner chamber and the inner surface of said outer container, b) to provide extra strength to said inner chamber in a selective manner according to at least one of position and dimensions of said at least one protrusion, and c) to reduce a distance between said inner chamber and said inner surface of said outer container.

14. A container according to claim 1, wherein said container further comprises at least one extra inner chamber, wherein said at least one extra inner chamber is adapted to be attached to at least one of the inner chamber and said at least one extra inner chamber by the gripping area of said at least one extra inner chamber, wherein the opening area of each of said at least one extra inner chamber is further adapted to be closed by at least one of said at least one extra inner chamber and a lid, and wherein the opening area of said at least one extra inner chamber is adapted to be opened by said force exerted on an outer surface of said outer container, thereby enabling the release of at least a portion of said inner contents from within at least one of the inner chamber and said at least one extra inner chamber.

15. A container according to claim 1, wherein said opening area comprises at least one aperture along said opening area such that when said closing means and said opening area are pushed one toward each other, said closing means displaces a fluid from within said inner chamber through said at least one aperture.

* * * * *